US005612725A

United States Patent [19]

Okimoto

[11] Patent Number: 5,612,725

[45] Date of Patent: Mar. 18, 1997

[54] INK-JET RECORDING HEAD WITH PLASTIC AND GLASS PLATES

[75] Inventor: Kazuki Okimoto, Kawasaki, Japan

[73] Assignee: Fuji Electric Co., Ltd., Kanagawa, Japan

[21] Appl. No.: 440,620

[22] Filed: May 15, 1995

[30] Foreign Application Priority Data

May 16, 1994 [JP] Japan ..... 6-100331

[51] Int. Cl.[6] ..... B41J 2/045

[52] U.S. Cl. ..... 347/71; 347/70; 347/68

[58] Field of Search ..... 347/68, 70, 71, 347/40

[56] References Cited

U.S. PATENT DOCUMENTS

| | | | |
|---|---|---|---|
| 4,434,430 | 2/1984 | Koto | 347/71 |
| 4,703,333 | 10/1987 | Hubbard | 347/71 |
| 5,396,042 | 3/1995 | Ishida et al. | 347/70 |

OTHER PUBLICATIONS

Patent Abstracts of Japan, vol. 15, No. 378 (M1161) 24 Sep. 1991, (JPA 03 151 240).

Patent Abstracts of Japan, vol. 16, No. 169 (M1239) 23 Apr. 1992, (JPA 04 14 459).

Patent Abstracts of Japan, vol. 17, No. 30 (C1018) 20 Jan. 1993, (JPA 04 248 880).

Rakeshpopli and Leo Mandelkern, Influence of Structural and Morphological Factors on the Mechanical Properties of the Polyethylenes, Journal of Polymer Science Part B Polymer Physics, vol. 25, 441–483 (1987).

*Primary Examiner*—Benjamin R. Fuller

*Assistant Examiner*—Charlene Dickens

*Attorney, Agent, or Firm*—Finnegan, Henderson, Farabow, Garrett & Dunner, L.L.P.

[57] ABSTRACT

An ink-jet recording head whose nozzles and ink flow channels can readily be formed and thus mass produced and which uses inexpensive glass and plastic plates. A combination of an oscillating plate 2 and an intermediate film 3, and that of an intermediate nozzle film 5 and a terminal nozzle plate 6 are each joined together by bonding adhesives, whereas a combination of an intermediate film 3 and a cavity plate 4, and that of the cavity plate 4 and the intermediate nozzle film 5 are each joined together by thermal fusion bonding. As the melt temperatures 190° C. of an intermediate film 3 of polysulfone and the intermediate nozzle film 5 are lower than the thermal deformation temperature 200° C. of the cavity plate 4 of polyetherimide, the pressurizing chambers **4*d* and flow channels 4*c* of the cavity plate 4 are made free from thermal deformation. Moreover, the inner face of a through-hole comprising the entry port 4*a*, reservoir 4*b*, flow channel 4*c* and pressurizing chamber 4*d* of the cavity plate 4, and the inner face of the intermediate nozzle 5*a* of the intermediate nozzle film 5 are so treated that they are made hydrophilic through an ozonizing process, whereas the inner and open faces of a terminal nozzle 6*a*** are so treated that they are made water-repellent.

4 Claims, 3 Drawing Sheets

INK-JET RECORDING HEAD WITH PLASTIC AND GLASS PLATES

BACKGROUND OF THE INVENTION

1. Field of the Invention

The present invention relates to an ink-jet printing head using inexpensive glass or plastic plates in which nozzles and ink flow channels are readily formed and which are fit for mass production.

2. Description of Related Art

A method for recording characters on a recording medium such as paper by sending out jets of ink through very small nozzles to make the ink stick thereto is known as an ink-jet recording method and on-demand type ink-jet recording heads are those based on the method above. The ink-jet recording head of this type (hereinafter called the "recording head") roughly comprises, as shown in a top view of FIG. 3 to better illustrate the groove side of a cavity plate and a sectional view of FIG. 4, a cavity plate 11, an oscillating plate 19, and piezoelectric elements 20 as electromechanical transducers each laid, on the outside face of the oscillating plate 19, opposite via conductive films to ink pressurizing chambers 15. When the cavity plate 11 ie combined with the oscillating plate 19, ink-jet nozzles 12, jet flow channels 13, ink pressurizing chambers 15, ink supply lines 16, filter flow channels 18, and an ink reservoir 17 for common use are formed as corresponding undulations have been formed by etching, machining or the like in the cavity plate 11 made of silicon, glass or metal. In this structure, the oscillating plate 19 is displaced toward the inside of the ink pressurizing chamber 15 so as to sharply reduce the capacity of the ink pressurizing chamber 15 when voltage as an electric signal is applied to the piezoelectric element 20. As a result, a quantity of ink equivalent to the reduced capacity of the ink pressurizing chamber 15 is jetted out of the nozzle 12 and the ink drops produced thereby are made to stick to opposite recording paper, so that characters are printed thereon.

In the case of a conventional ink-jet recording head of the sort mentioned above, an electrostatic bonding technique is applied to bonding the cavity plate 11 and the oscillating plate 19 together when the former and the latter are a silicon wafer and a glass plate, respectively. When a plastic cavity plate 11 is used for reducing material cost, making it easy to machine fine grooves and thus increasing mass producibility, bonding adhesives and thermal fusion bonding by heat-fusing the plastics itself are employed for bonding purposes. However, there are drawbacks common to the prior art in that the durability of the joint is inferior and that the flow channel shape is not kept accurate and is therefore slightly ruined; consequently, there has developed a demand for reliable bonding techniques. In view of improving durability and rigidity, it is put under technological scrutiny to use engineering plastics such as polyetherimide, polysulfone, polyetherketone, polyethersulfone and the like for such cavity and oscillating plates. Since these materials are generally difficult to join by means of bonding adhesives, a thermal fusion bonding method is being studied. The thermal fusion bonding method is advantageous in that bonding reliability is extremely high because no adhesive interface with a different material such as a bonding adhesive exists. Notwithstanding, there also arises the problem of thermal deformation of very small ink flow channels formed in the surface of the cavity plate due to the heat added to those plastics.

SUMMARY OF THE INVENTION

An object of the present invention intended to solve and obviate the foregoing problems is to provide an ink-jet recording head whose nozzles and ink flow channels can readily be formed and thus mass-produced and which uses inexpensive glass and plastic plates.

An ink-jet recording head according to the present invention comprises: a glass oscillating plate with piezoelectric elements placed thereon, a plastic intermediate film, a plastic cavity plate having a thermal deformation temperature higher than the melt temperature of the intermediate film, and through-holes for use as pressurizing chambers, the through-holes being bored in the direction of thickness of the cavity plate, a plastic intermediate nozzle film having a melt temperature lower than the thermal deformation temperature of the cavity plate, and intermediate nozzles each capable of communicating with the pressurizing chambers, the intermediate nozzles being bored in the direction of thickness of the intermediate nozzle film, and a plastic terminal nozzle plate having terminal nozzles each capable of communicating with the intermediate nozzles, the terminal nozzles being bore in the direction of thickness of the terminal nozzle plate, wherein the oscillating plate, the intermediate film, the cavity plate, the intermediate nozzle film and the terminal nozzle plate are stacked up in the order of the description given above; the combination of the oscillating plate and the intermediate film, and that of the intermediate nozzle film and the terminal nozzle plate are each joined together via bonding adhesives; and the combination of the intermediate film and the cavity plate, and that of the cavity plate and the intermediate nozzle film are each joined together by thermal fusion bonding. Moreover, the inner faces of the through-holes and the intermediate nozzles in particular should preferably be so treated that the inner faces thereof are made hydrophilic, whereas the inner and open faces of the terminal nozzles should also preferably be so treated that the inner and open faces thereof are made water-repellent.

An ink-jet recording head according to the present invention comprises: a glass oscillating plate with piezoelectric elements placed thereon, a first plastic intermediate film, a plastic cavity plate having a melt temperature substantially equal to the melt temperature of the first intermediate film, and through-holes for use as first pressurizing chambers, the through-holes being bored in the direction of thickness of the cavity plate, a plastic nozzle plate having a thermal deformation temperature higher than the melt temperature of the cavity plate, and slit-like ink flow channels, each of which includes a nozzle open to the edge face on one side and a second pressurizing chamber, and is capable of communicating with the first pressurizing chamber of the cavity plate at the second pressurizing chamber, a second plastic intermediate film having a melt temperature lower than the thermal deformation temperature of the nozzle plate, and a glass surface plate, wherein the oscillating plate, the first intermediate film, the cavity plate, the nozzle plate, the second intermediate film and the surface plate are stacked up in the order of the description given above; the combination of the oscillating plate and the first intermediate film, and that of the second intermediate film and the surface plate are each joined together via bonding adhesives; and the combination of the first intermediate film and the cavity plate, that of the cavity plate and the nozzle plate, and that of the nozzle plate and the second intermediate film are each Joined together by thermal fusion bonding. Moreover, the inner faces of the elite should preferably be so treated that the inner faces thereof are made hydrophilic.

Although the combination of the oscillating plate and the intermediate film, and that of the intermediate nozzle film and the terminal nozzle plate are each joined together via bonding adhesives according to the present invention, there is not the slightest fear of thermal deformation when these plates and films are bonded together. Although the combination of the intermediate film and the cavity plate, and that of the intermediate film and the intermediate nozzle film are each joined together by thermal fusion bonding, moreover, the melt temperatures of the intermediate film and the intermediate nozzle film are both lower than the temperature at which the cavity plate undergoes thermal deformation. Consequently, when the intermediate film and the intermediate nozzle film are joined together by thermal fusion bonding at that melting temperature, the pressurizing chambers of the cavity plate and the flow channels coupled thereto will never undergo thermal deformation at the melting temperature. Therefore, the intermediate film and the intermediate nozzle film are securely joined together and since the nozzles and the flow channels are kept in shape, not only excellent ink-jet characteristics but also good printing quality is maintained. Moreover, the inner faces of the through-hole and the intermediate nozzle are so treated that the inner faces thereof are made hydrophilic, whereas the inner and open faces of the terminal nozzle are so treated that the inner and open faces thereof are made water-repellent. The former treatment of making the through-hole and the intermediate nozzle hydrophilic results in improving the wetting properties with ink and rendering bubbles readily removable, whereas the latter water-repellent treatment results in restraining ink from being left on the face of the nozzle after it is jetted out.

The combination of the oscillating plate and the first intermediate film, and that of the second intermediate film and the surface plate are each bonded together via bonding adhesives. However, there is not the slightest fear of thermal deformation of these plates and films. Moreover, the combination of the first intermediate film and the cavity plate, that of the cavity plate and the nozzle plate, and that of the nozzle plate and the second intermediate film are each joined together by thermal fusion boding. Even when the first intermediate film and the cavity plate are bonded together by thermal fusion bonding at their melt temperatures, there is not the slightest fear of thermal deformation of them as there exist no fine flow channels. Since the melt temperatures of the cavity plate and the intermediate film are lower than the thermal deformation temperature of the nozzle plate, moreover, the pressurizing chambers of the nozzle plate, and the flow channels each coupled to the pressurizing chambers are prevented from undergoing thermal deformation even when the cavity plate and the intermediate film are bonded together by thermal fusion bonding at their melt temperatures. In addition, the inner face of the slat is so treated that the inner face thereof is made hydrophilic so as to improve the wetting properties with ink.

The above and further objects, features and advantages of the invention will appear more fully from the accompanying drawings and the following detailed description.

DETAILED DESCRIPTION OF THE PREFERRED EMBODIMENTS

Figure 1:
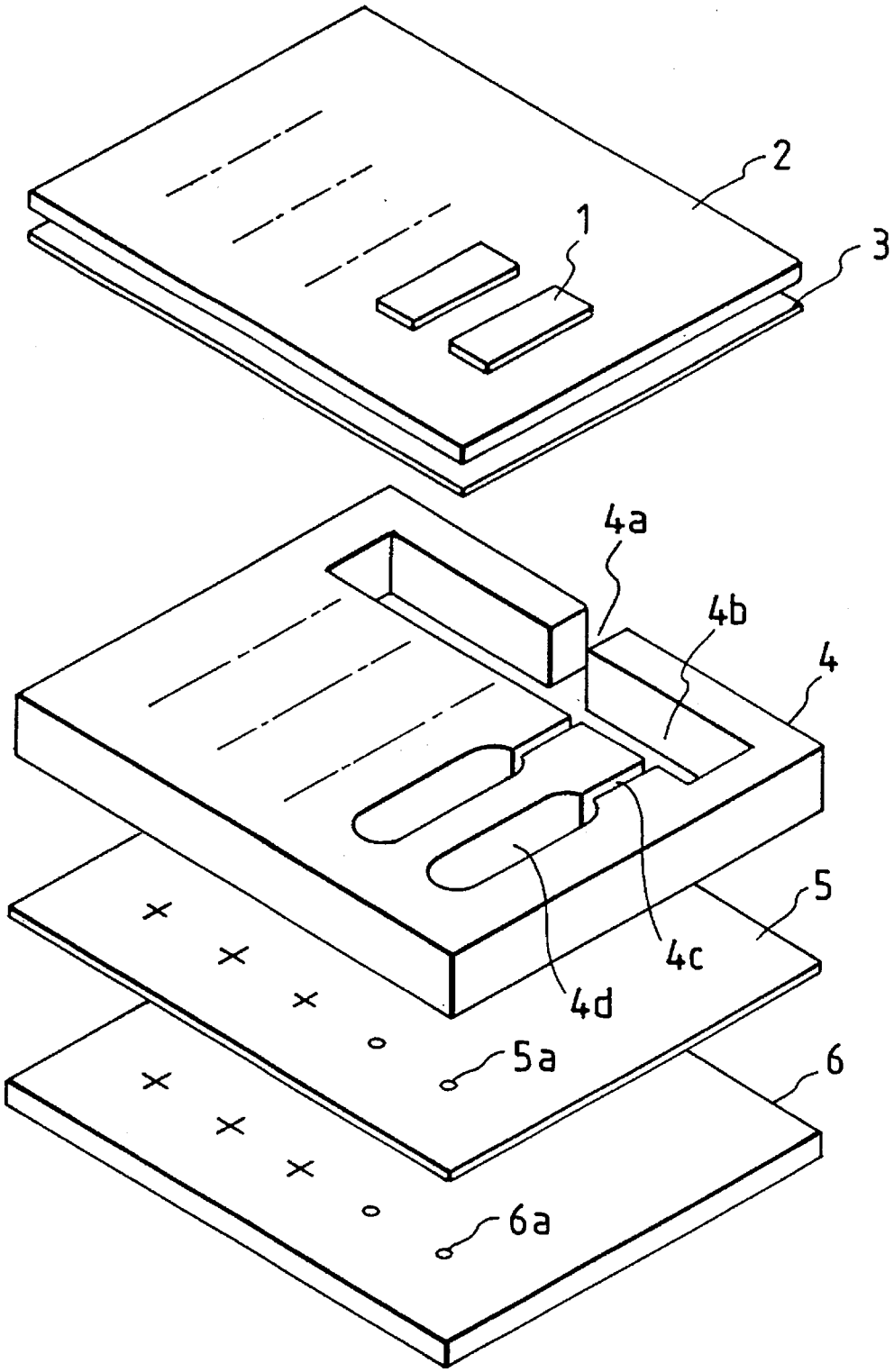
FIG. 1 is an exploded perspective view showing an ink-jet recording head according to a first embodiment of the present invention.

Referring to the drawings, a description will be given of an ink-jet recording head embodying the present invention. FIG. 1 is an exploded perspective view of a first embodiment of the present invention. In FIG. 1, an oscillating plate 2 is made of glass, and the mechanical distortion of each piezoelectric element 1 to be bonded to the oscillating plate 2 is precisely converted into a change in the volume of each pressurizing chamber **4*d* of a cavity plate 4. An intermediate film 3 is a platelike member of polysulfone resin which is 50 μm thick. The cavity plate 4 is a platelike member of polyetherimide 200 μm thick. An entry port 4*a*, a reservoir 4*b*, a flow channel 4*c* and the pressurizing chamber 4*d* communicating with each other are bored in the form of a through-hole in the cavity plate 4. An intermediate nozzle film 5 is a platelike member of polysulfone resin 50 μm thick and has intermediate nozzles 5*a* each communicating with the pressurizing chambers 4*d* of the cavity plate 4. A terminal nozzle plate 6 is a platelike member of glass 100 μm thick and has precise terminal nozzles 6*a* each communicating with the intermediate nozzles 5*a* of the intermediate nozzle film 5, the precision terminal nozzles 6*a* being used to send out jets of ink. The diameter of each intermediate nozzle 5*a* in this case is slightly greater than that of the terminal nozzle 6*a*** and the measurement of the former need not be precise so much.

The combination of the oscillating plate 2 and the intermediate film 3, and that of the intermediate nozzle film 5 and the terminal nozzle plate 6 are each bonded together via bonding adhesives. Since no intense heat is added when these plates and films are bonded together, the terminal nozzles are see free from thermal deformation then. Moreover, the combination of the intermediate film 3 and the cavity plate 4, and that of the cavity plate 4 and the intermediate nozzle film 5 are each joined together by thermal fusion bonding. The melt temperatures of the intermediate film 3 and the intermediate nozzle film 5 are approximately 190° C., which is lower than 200° C. at which the cavity plate 4 undergoes thermal deform When the intermediate film 3 and the intermediate nozzle film 5 are joined together by thermal fusion bonding at a melt temperature of 190° C., the pressurizing chambers **4*d* of the cavity plate 4 and the flow channels 4*c*** each communicating therewith will never undergo thermal deformation at that melt temperature of 190° C. Incidentally, polyester and polyarylate resins whose melt temperatures are each approximately 188° C. and 185° C., both of which are slightly lower than that of polysulfone resin, may be employed instead.

Further, the inner face of the through-hole formed with the entry port **4*a*, the reservoir 4*b*, the flow channel 4*c* and the pressurizing chamber 4*d* of the cavity plate 4, and that of the intermediate nozzle 5*a* of the intermediate nozzle film 5 are made hydrophilic through an ozonizing process. In other words, the molecular structure of the plastic surface corresponding to the inner face above is modified in quality and an OH radical is formed to increase its activity; as a result, the ink-repellent property is restrained and the wetting properties with ink are improved. Further, the inner and open faces of the terminal nozzle 6*a* are made water-repellent, that is, coated with a water-repellent film, for example. Consequently, the meniscus of ink on the recording head side retracts from the open face of the terminal nozzle 6***a* after the ink is jetted out, so that the ink ie hardly left at the nozzle tip.

Figure 2:
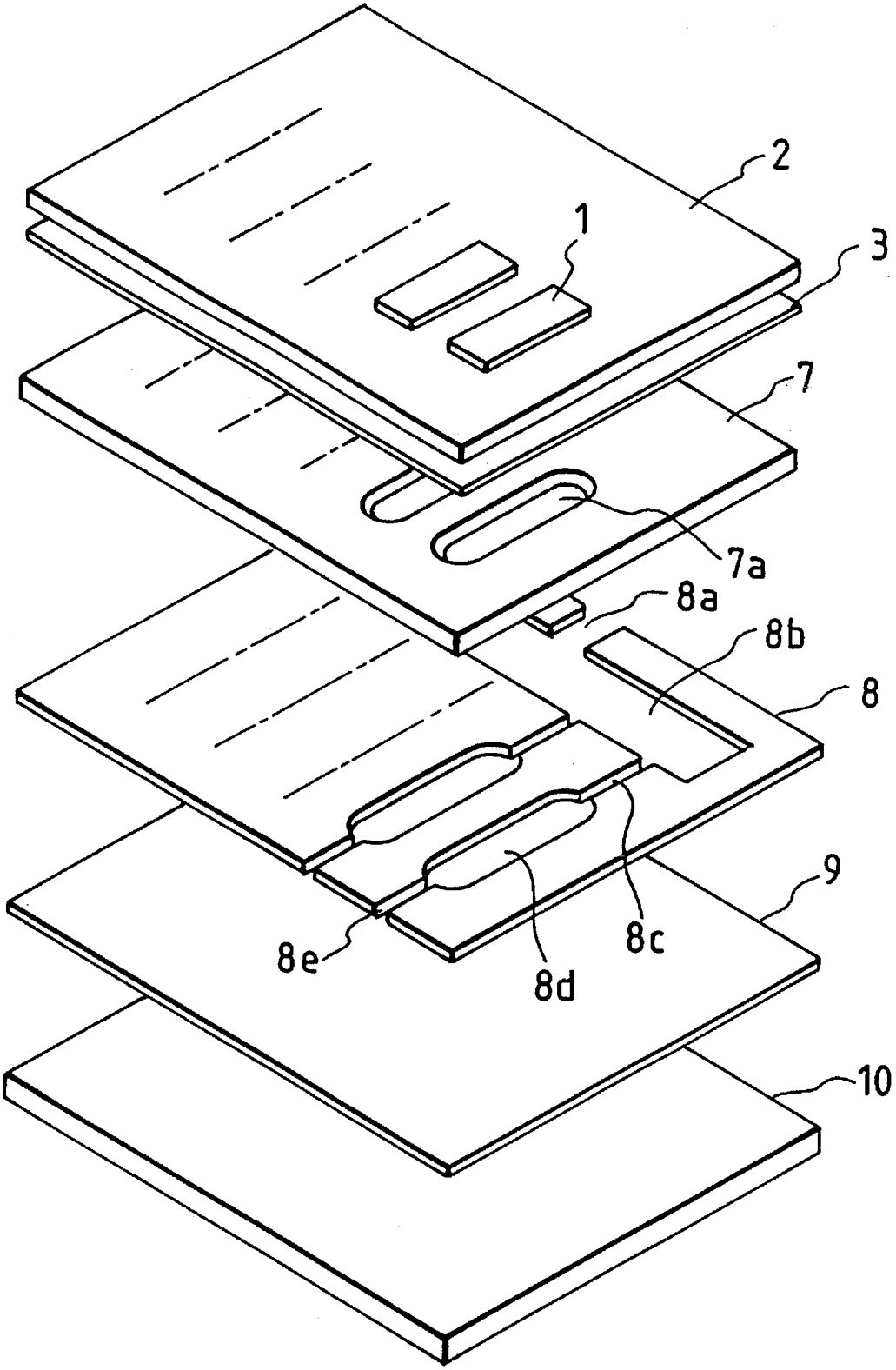
FIG. 2 is an exploded perspective view showing an ink-jet recording head according to a second embodiment of the present invention.
Figure 3:
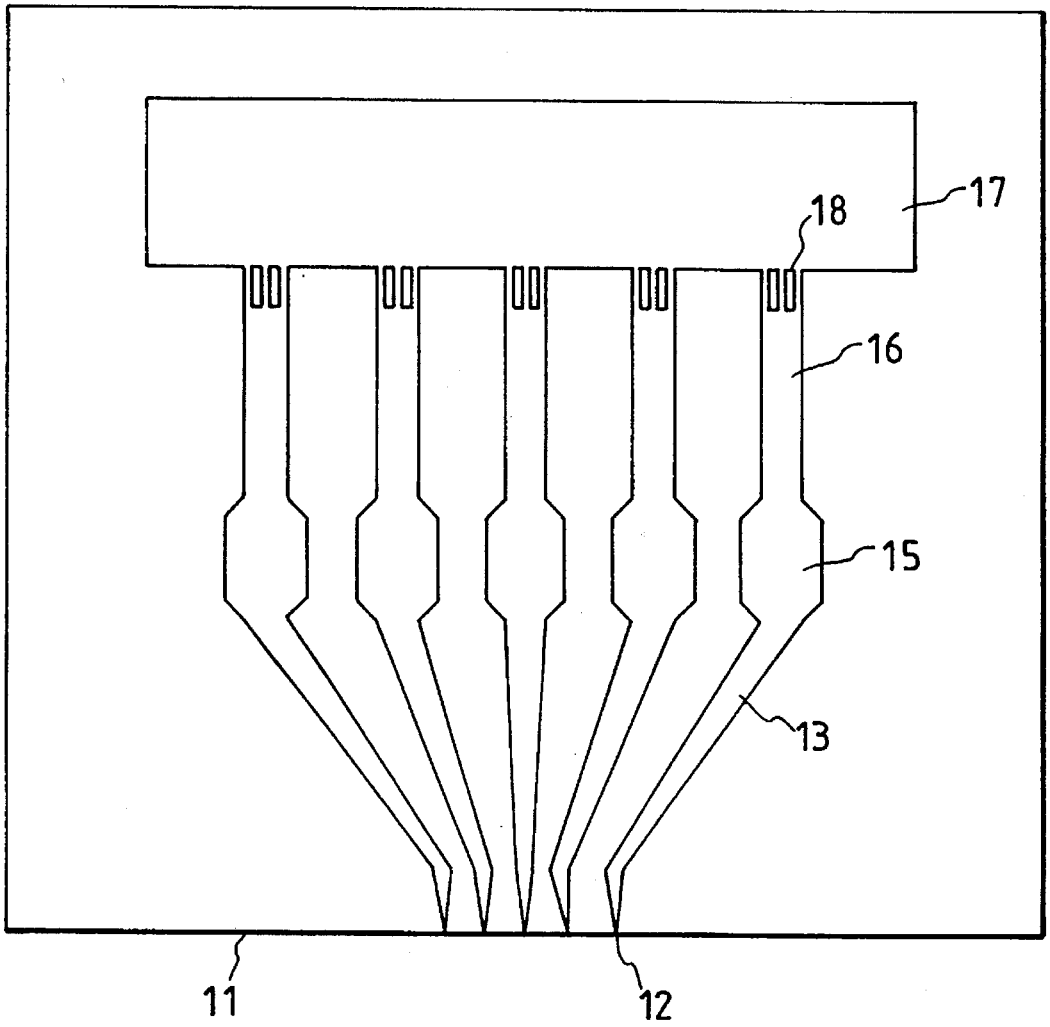
FIG. 3 (PRIOR ART)
FIG. 3 is a top view showing a conventional ink-jet recording head by way of example.
Figure 4:
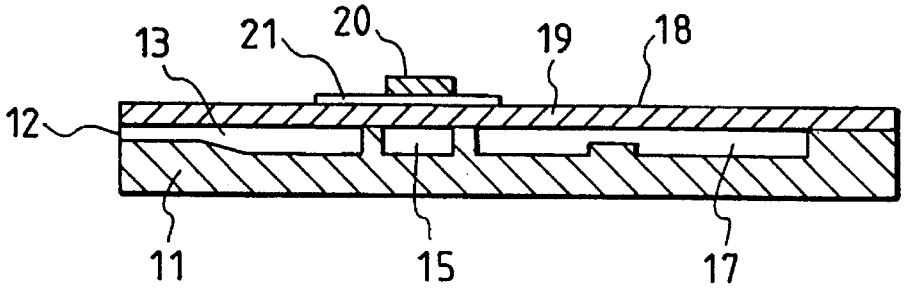
FIG. 4 (PRIOR ART)
FIG. 4 is a sectional view showing the conventional ink-jet recording head of FIG. 3.

FIG. 2 is an exploded perspective view of a second embodiment of the present invention. In FIG. 2, an oscillating plate 2 is made of glass for the same reason that has been stated in reference to the first embodiment of the present invention. An intermediate film 3 as a first intermediate film is a platelike member of polysulfone resin which is 50 μm thick. A cavity plate 7 is a platelike member of polysulfone resin 200 μm thick, and pressurizing chambers 7*a* are bored in the form of through-holes therein. A nozzle plate 8 is a platelike member of polyetherimide resin 50 μm thick. An entry port 8*a*, a reservoir 8*b*, flow channels 8*c*, pressurizing chambers 8*d* and nozzles 8*e* communicating with each other are bored in the form of slits in the nozzle plate 8; in this case, these parts of the nozzle plate 8 are first integrally formed with a coupling member lest they should be disintegrated and the coupling member is removed after the nozzle plate 8 is joined to become what is configured in FIG. 2. The pressurizing chamber 8*d* and the pressurizing chamber 7*a* of the cavity plate 7 communicate with each other. An intermediate film 9 as a second intermediate film is a platelike member of polysufone resin 50 μm thick. A surface plate 10 is made of glass.

The combination of the oscillating plate 2 and the intermediate film 3, and that of the intermediate film 9 and the surface plate 10 are each bonded together via bonding adhesives. However, there is not the slightest fear of thermal deformation when these films and plate are bonded together. Moreover, the combination of the intermediate film 3 and the cavity plate 7, that of the cavity plate 7 and the nozzle plate 8, and that of the nozzle plate 8 and the intermediate film 9 are each joined together by thermal fusion boding. Even when the intermediate film 3 and the cavity plate 7 are bonded together by thermal fusion bonding at a melt temperature of 190° C., these film and plate are set free from ill effects such as thermal deformation as there exist no fine flow channels. Since the melt temperature 190° C. of the cavity plate 7 and the intermediate film 9 is lower than the thermal deformation temperature 200° C. of the nozzle plate 8, moreover, the nozzle plate 8, the pressurizing chambers 8*d*, the flow channels 8*c* each coupled to the pressurizing chambers 8*d*, and the nozzles 8*e* are prevented from undergoing thermal deformation even when the cavity plate 7 and the intermediate film 9 are bonded together at the melt temperature of 190° C. In addition, the inner face of the slit of the nozzle plate 8 is, as in the first embodiment, made hydrophilic so as to improve the wetting properties with ink.

Although the combination of the intermediate film and the cavity, and that of the cavity plate and the intermediate nozzle film are each joined together by thermal fusion bonding according to the present invention, the melt temperatures of the intermediate film and the intermediate nozzle film are both lower than the temperature at which the cavity plate undergoes thermal deformation. When the intermediate film and the intermediate nozzle film are Joined together by thermal fusion bonding at that melting temperature, the pressurizing chambers of the cavity plate and the flow channels coupled thereto will never undergo thermal deformation at the melting temperature. Therefore, the intermediate film and the intermediate nozzle film are securely joined together and since the nozzles and the flow channels are kept in shape, not only excellent ink-jet characteristics but also good printing quality is maintained. Moreover, the inner faces of the through-hole and the intermediate nozzle are made hydrophilic, whereas the inner face of the terminal nozzle and the open face of the terminal nozzle are made water-repellent. The former process of making the through-hole and the intermediate nozzle hydrophilic results in improving the wetting properties with ink and rendering bubbles readily removable, whereas the latter water-repellent process results in restraining ink from being left on the face of the nozzle after it is jetted out, preventing the nozzle from being clogged therewith and restraining printing quality from being deteriorated. Further, the fact that the platelike and film members constituting the recording head are made of glass and plastics provides the basis for setting forth the merit of reducing material cost, making it easy to mold nozzles and ink flow channels, thus increasing mass producibility.

The combination of the oscillating plate and the first intermediate film, and that of the second intermediate film and the surface plate are each bonded together via bonding adhesives. However, there is not the slightest fear of thermal deformation as neither small nozzles nor fine flow channels exist. Moreover, the combination of the first intermediate film and the cavity plate, that of the cavity plate and the nozzle plate, and that of the nozzle plate and the second intermediate film are each joined together by thermal fusion boding. Even when the first intermediate film and the cavity plate are bonded together by thermal fusion bonding at their melt temperatures, these film and plate are set free from ill effects such as thermal deformation as there exist no fine flow channels. Since the melt temperatures of the cavity plate and the intermediate film are lower than the thermal deformation temperature of the nozzle plate, moreover, the pressurizing chambers of the nozzle plate, and the flow channels each coupled to the pressurizing chambers are prevented from undergoing thermal deformation even when the cavity plate and the intermediate film are bonded together at their melt temperatures; therefore, the cavity plate and the intermediate film are securely bonded together. Since the nozzles and the flow channels are kept in shape, not only excellent ink-jet characteristics but also good printing quality is maintained. In addition, the inner face of the slit of the nozzle plate is made hydrophilic so as to improve the wetting properties with ink and make bubbles readily removable.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An ink-jet recording head, comprising:

a glass oscillating plate with a plurality of piezoelectric elements mounted thereon;

an intermediate film formed of a plastic, having a melt temperature;

a cavity plate formed of a plastic having a thermal deformation temperature higher than the melt temperature of the plastic forming said intermediate film, and provided with a plurality of through-holes wherein each of said plurality of through-holes are pressurizing chambers, said through-holes extending through a thickness of said cavity plate;

an intermediate nozzle film formed of a plastic having a melt temperature lower than the thermal deformation temperature of the plastic forming said cavity plate, and provided with a plurality of intermediate nozzles each communicating with a corresponding one of said pressurizing chambers, said intermediate nozzles extending through a thickness of said intermediate nozzle film; and a glass terminal nozzle plate having a plurality of terminal nozzles, each communicating with one of said intermediate nozzles, said terminal nozzles extending through a thickness of said terminal nozzle plate;

wherein said oscillating plate, said intermediate film, said cavity plate, said intermediate nozzle film and said terminal nozzle plate are Sequentially stacked one on another; said oscillating plate and said intermediate film being joined together by a bonding adhesive, and said intermediate nozzle film and said terminal nozzle plate being joined together by a bonding adhesive; and said intermediate film and said cavity plate being joined together by thermal fusion bonding, and said cavity plate and said intermediate nozzle film joined together by thermal fusion bonding.

2. An ink-jet recording head as claimed in claim 1, wherein said through-holes and said intermediate nozzles have inner faces which are hydrophilic, and said terminal nozzles have inner and open faces which are water-repellent.

3. An ink-jet recording head, comprising:

a glass oscillating plate with piezoelectric elements mounted thereon;

a first intermediate film formed of a plastic having a melt temperature;

a cavity plate formed of a plastic having a thermal deformation temperature substantially equal to the melt temperature of said first intermediate film, and provided with a plurality of through-holes wherein each of said plurality of through-holes is a first pressurizing chamber, said through-holes extending through a thickness of said cavity plate;

a nozzle plate formed of a plastic having a melt temperature higher than the thermal deformation temperature of the plastic forming said cavity plate, and provided with a plurality of slit-like ink flow channels having a edge face each of said channels including a nozzle opening to the edge face and a second pressurizing chamber communicating with said first pressurizing chamber of said cavity plate;

a second intermediate film formed of a plastic having a melt temperature lower than the thermal deformation temperature of the plastic forming said nozzle plate; and a glass surface plate;

wherein said oscillating plate, said first intermediate film, said cavity plate, said plastic nozzle plate, said second intermediate film and said glass surface plate are sequentially stacked one on another; said oscillating plate and said first intermediate film being joined together by a bonding adhesive, said second intermediate film and said glass surface plate being joined together by a bonding adhesive; and said first intermediate film and said cavity plate joined together by thermal fusion bonding, said cavity plate and said nozzle plate, being joined together by thermal fusion bonding, and said nozzle plate and said second intermediate film being joined together by thermal fusion bonding.

4. An ink-jet recording head as claimed in claim 3, wherein said flow channels have inner faces which are hydrophilic.

* * * * *

UNITED STATES PATENT AND TRADEMARK OFFICE

CERTIFICATE OF CORRECTION

PATENT NO. : 5,612,725

DATED : March 18, 1997

INVENTOR(S) : Kazuki OKIMOTO

It is certified that error appears in the above-indentified patent and that said Letters Patent is hereby corrected as shown below:

On the Title page, Item [57],
in the Abstract, line 2, "mass produced" should read --mass-produced--.

Claim 1, column 7, line 17, "Sequentially" should read --sequentially--.

Claim 3, column 8, line 9, "a edge" should read --an edge--.

Signed and Sealed this

Twenty-eighth Day of October, 1997

Bruce Lehman

*Attest:*

BRUCE LEHMAN

*Attesting Officer*

*Commissioner of Patents and Trademarks*